US006630921B2

(12) United States Patent
Janssen et al.

(10) Patent No.: US 6,630,921 B2
(45) Date of Patent: Oct. 7, 2003

(54) COLUMN DRIVING CIRCUIT AND METHOD FOR DRIVING PIXELS IN A COLUMN ROW MATRIX

(75) Inventors: Peter J. Janssen, Scarborough, NY (US); Lucian Remus Albu, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 182 days.

(21) Appl. No.: 09/812,489

(22) Filed: Mar. 20, 2001

(65) Prior Publication Data

US 2002/0135557 A1 Sep. 26, 2002

(51) Int. Cl.[7] ..... G09G 3/36
(52) U.S. Cl. ..... 345/100
(58) Field of Search ..... 345/87, 92, 100, 345/103, 95, 88, 89, 93–96, 98; 349/33, 41, 42

(56) References Cited

U.S. PATENT DOCUMENTS 4,781,438 A * 11/1988 Noguchi ..... 349/54
6,310,628 B1 * 10/2001 Matsushita et al. ..... 219/411
6,424,328 B1 * 7/2002 Ino et al. ..... 345/87

* cited by examiner

*Primary Examiner*—Chanh Nguyen
(74) *Attorney, Agent, or Firm*—Steven R. Biren

(57) ABSTRACT

A column driving circuit and method for driving pixels in a column row matrix. Specifically, the present invention provides a circuit and method that generally includes an input for receiving a signal, a multiplexing circuit for receiving the signal from the input, and a first and a second column line, wherein each column line alternates in receiving the signal from the multiplexing circuit. By splitting the signal between two column lines, overall line capacitance is reduced, as are problems associated with delays in ramp retrace.

15 Claims, 6 Drawing Sheets

COLUMN DRIVING CIRCUIT AND METHOD FOR DRIVING PIXELS IN A COLUMN ROW MATRIX

BACKGROUND OF THE INVENTION

1. Technical Field

The present invention generally relates to a column driving circuit and method for driving pixels in a column row matrix. More particularly, the present invention relates to an improved circuit and method for reducing the capacitive load on the columns of the matrix to provide improved pixel driving.

2. Background Art

In video displays, matrices are commonly utilized in which pixels are oriented in a column row format. The column driving scheme currently employed to drive the pixels is based on a common analog ramp signal that is sampled by all columns in the display. Problems associated with this architecture include a high capacitive load that each column presents to the column buffer, where a buffer amplifier is used in every column. Moreover, as the addressing frequency increases, as a result of a higher frame rate or a higher pixel count of the display, the fidelity of the sampled signal decreases.

Another problem associated with the existing architecture is ramp retrace. In particular, the ramp signal in each column must retrace rapidly to an initial state in order to maximize the time available for sampling. Specifically, before the columns of the existing architecture can be driven with the analog signal, they must first be brought to an initial state or retraced. Thus, driving the pixels is at least a two step process in which each column must: (1) retrace to initial state; and (2) apply the analog signal. Since, a fast retrace requires large current capability of the driver(s), the associated large transients in the matrix could cause undesired effects, e.g., activating unselected rows.

In view of the foregoing, there exists a need for a column driving circuit and method for reducing the capacitive load in the columns of the matrix. Moreover, a need exists for a column driving circuit and method that reduces the problems associated with ramp retrace.

SUMMARY OF THE INVENTION

The present invention addresses the problems of the existing architecture by providing an improved column driving circuit and method for driving pixels in a column row matrix. Specifically, the present invention provides a column driving circuit wherein each column is split into at least two column lines. Each column line communicates with/is joined to a unique subset of rows in the matrix. By splitting the columns into multiple column lines, the capacitance of each line is a fraction of that required by a single column. In addition, because each column is split into at least two column lines, a first column line can be retraced to the initial state while the second column line is being driven by the analog signal thus, reducing the delays associated with ramp retrace.

According to a first aspect of the present invention, a column driving circuit for driving pixels in a column row matrix is provided. The circuit comprises: (1) a multiplexing circuit for receiving a signal; and (2) a first and a second column line, wherein the column lines receive the signal from the multiplexing circuit, and wherein the first column line is in communication with different rows of the matrix than the second column line.

According to a second aspect of the present invention, a column driving circuit for driving pixels in a column row matrix is provided. The circuit comprises: (1) a DAC (digital to analog converter) for generating an analog signal in response to a digital input; (2) a multiplexing circuit for receiving the signal from the DAC; (3) a first and a second column line, wherein the column lines alternate in receiving the signal from the multiplexing circuit; and (4) wherein each column line includes at least one junction for communicating with a unique subset of rows in the matrix.

According to a third aspect of the present invention, a method for driving pixels in a column row matrix is provided. The method comprises the steps of: (1) receiving a signal in a multiplexing circuit; (2) selectively sending the signal from the multiplexing circuit to a first and second column line; and (3) communicating the column lines with rows of the matrix to drive the pixels, wherein the first column line communicates with different rows than the second column line Therefore, the present invention provides a column driving circuit and method for driving pixels in a column row matrix. The present invention reduces the problems associated with high column capacitance and ramp retrace.

BRIEF DESCRIPTION OF THE DRAWINGS

These and other features and advantages of this invention will be more readily understood from the following detailed description of the various aspects of the invention taken in conjunction with the accompanying drawings in which.

Figure 1:
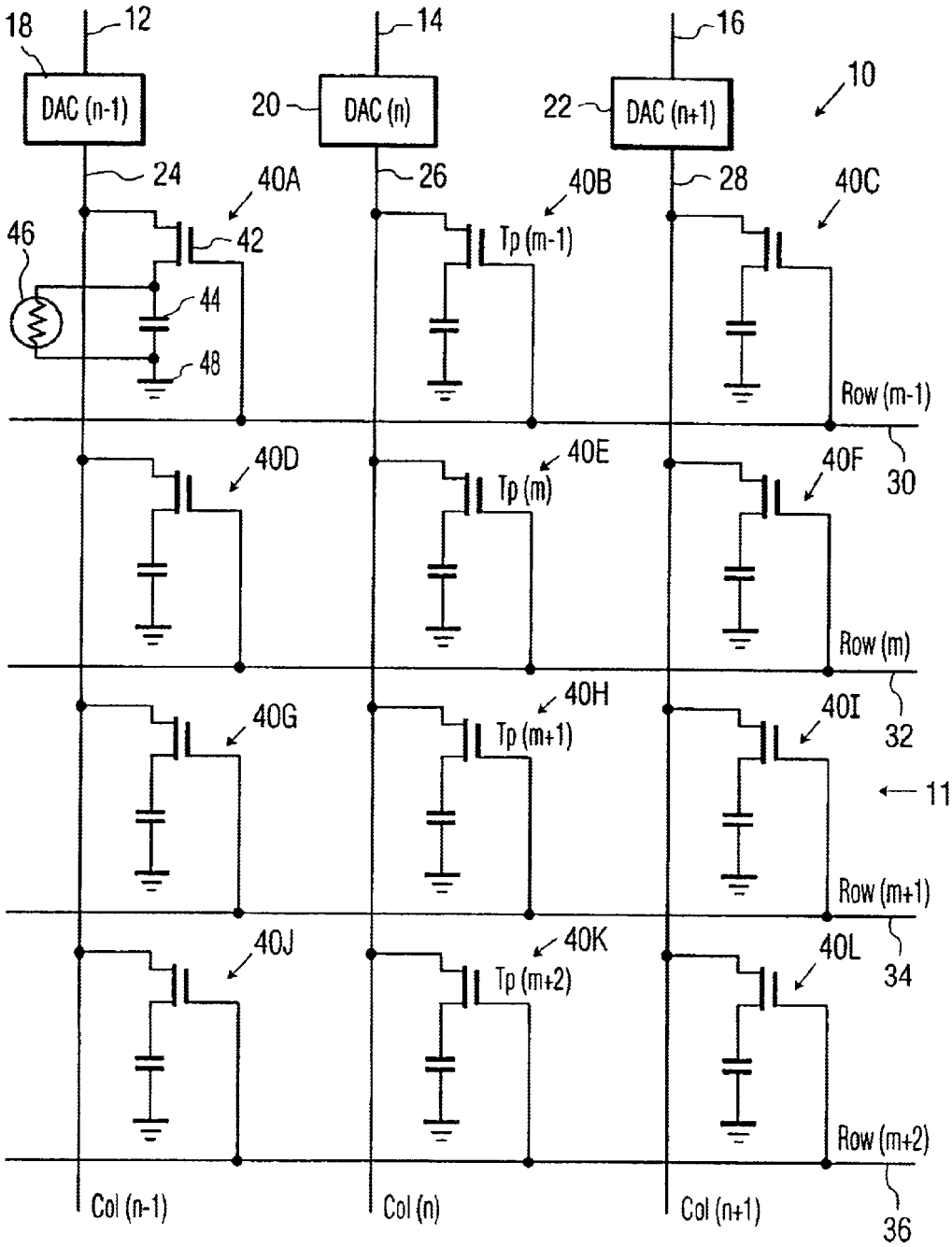
FIG. 1 PRIOR ART
FIG. 1 depicts a first prior art column driving circuit.

It is noted that the drawings of the invention are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE DRAWINGS

As stated, the present invention comprises an improved column driving circuit and method for driving pixels in a column row matrix. Generally, the present invention splits each column of the matrix into a plurality (preferably two) column lines. Each column line communicates with, or is joined, to a unique subset of rows in the matrix. Accordingly, the different column lines of a single column communicate with different (e.g., alternating) rows. An analog ramp signal then is alternately applied to the column lines within each column. The resulting configuration reduces the capacitance on each column line. Moreover, as the analog signal is being applied to a first column line, a second column line can be retraced to an initial state. Therefore, there is negligible delay for a column line to retrace to the initial state.

Referring first to FIG. 1, a prior art column driving circuit 10 is depicted. The circuit is for driving pixels in a column row matrix 11. As shown, the matrix comprises columns 24, 26, and 28 and rows 30, 32, 34, and 36. Digital input signals 12, 14, and 16 are received by each column via digital to analog converter (DACs) 18, 20, and 22. Each DAC converts the digital signal to an analog signal, which is then used to drive a particular column within the matrix. Specifically, the analog signal exits each DAC 18, 20, and 22 and is received by columns 24, 26, and 28, respectively. Each column 24, 26, and 28 includes a junction 40A–L to each row 30, 32, 34 and 36. Accordingly, each row controls one junction of each column. Each junction 40A–L generally comprises a pixel transistor 42, a capacitor 44, a pixel 46 and a ground 48. It should be understood that the capacitor 44 represents a capacitance associated with pixel 46. Accordingly, pixels 46 are not explicitly shown for each junction 40A–L. However, it should be understood that each junction 40A–L includes a pixel 46.

When a video display that includes matrix 11 is refreshed, each pixel 46 must be driven. To accomplish this, each row will be individually activated for a brief period of time. This allows the analog signal in each column 24, 26 and 28 to pass through the junctions 40A . L corresponding the activated row and drive the pixels. For example, if row 30 is to be refreshed, it will first be activated. The analog signals will then pass from columns 24, 26, and 28 through junctions 40A–C to drive the pixels in row 30. This will then be repeated for rows 32, 34, and 36.

As indicated above, however, this architecture presents many problems. In particular each column 24, 26, and 28 has a relatively high capacitance both from the lines and any un-activated pixel transistors, which requires more voltage, and results in reduced accuracy and bandwidth of the matrix. Moreover, before any column 24, 26, and 28 can receive the analog signal, it must first be retraced to an initial state. This delay associated with retrace reduces the maximum time available for sampling by the rows, which is especially problematic in larger matrices.

Figure 2:
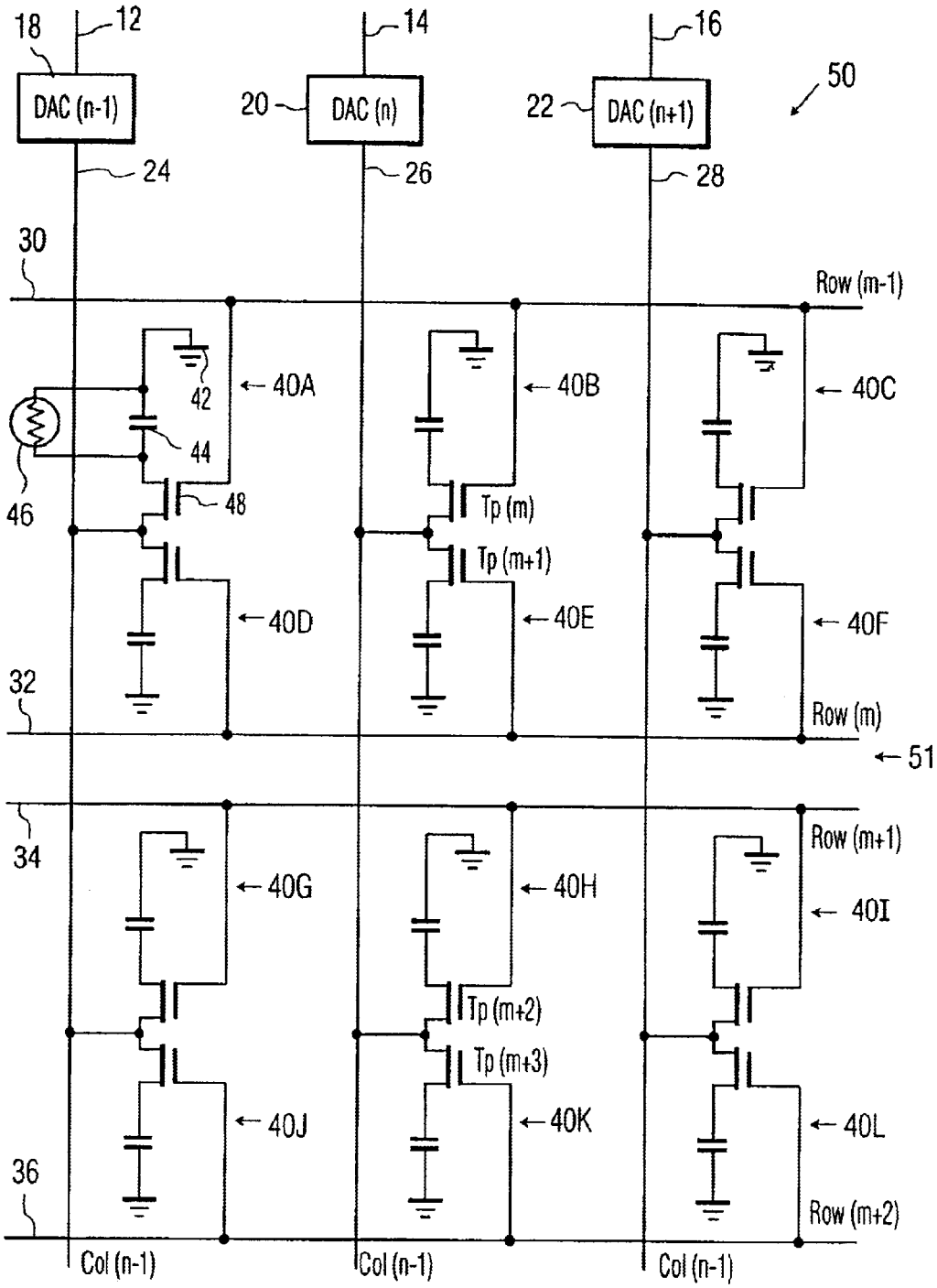
FIG. 2 PRIOR ART
FIG. 2 depicts a second prior art column driving circuit.

FIG. 2 shows a second prior art column driving circuit 50. This circuit 50 includes similar elements as circuit 10 and drives column row matrix 51. Specifically, circuit 50 receives digital signals 12, 14 and 16 in DACs 18, 20, and 22 and converts the signals from digital to analog. The analog signals are then passed to the columns 24, 26, and 28, which communicate with selectively activated rows 30, 32, 34 and 36. In embodiment of FIG. 2, however, each column communicates with pairs of rows instead of individual rows. For example, if row 30 is to be refreshed, it will first be activated. The analog signal will then pass through junctions 40A–C and drive the pixels therein.

The circuit 50 of FIG. 2 possesses the same drawbacks as circuit 10. Specifically, each column 24, 26, and 28 has a relatively high capacitance that requires more time to reach the capacity. This increase in time to reach capacity results in reduced accuracy and bandwidth of the matrix. Specifically, each un-activated transistor 42 has a parasitic capacitance slows the time to drive the column. Moreover, as indicated above, each column must be retraced to the initial state prior to communicating the analog signal through the junctions 40A–L. This retrace causes delay in the cycle and thus, reduces the maximum time available for sampling by the rows.

Figure 3:
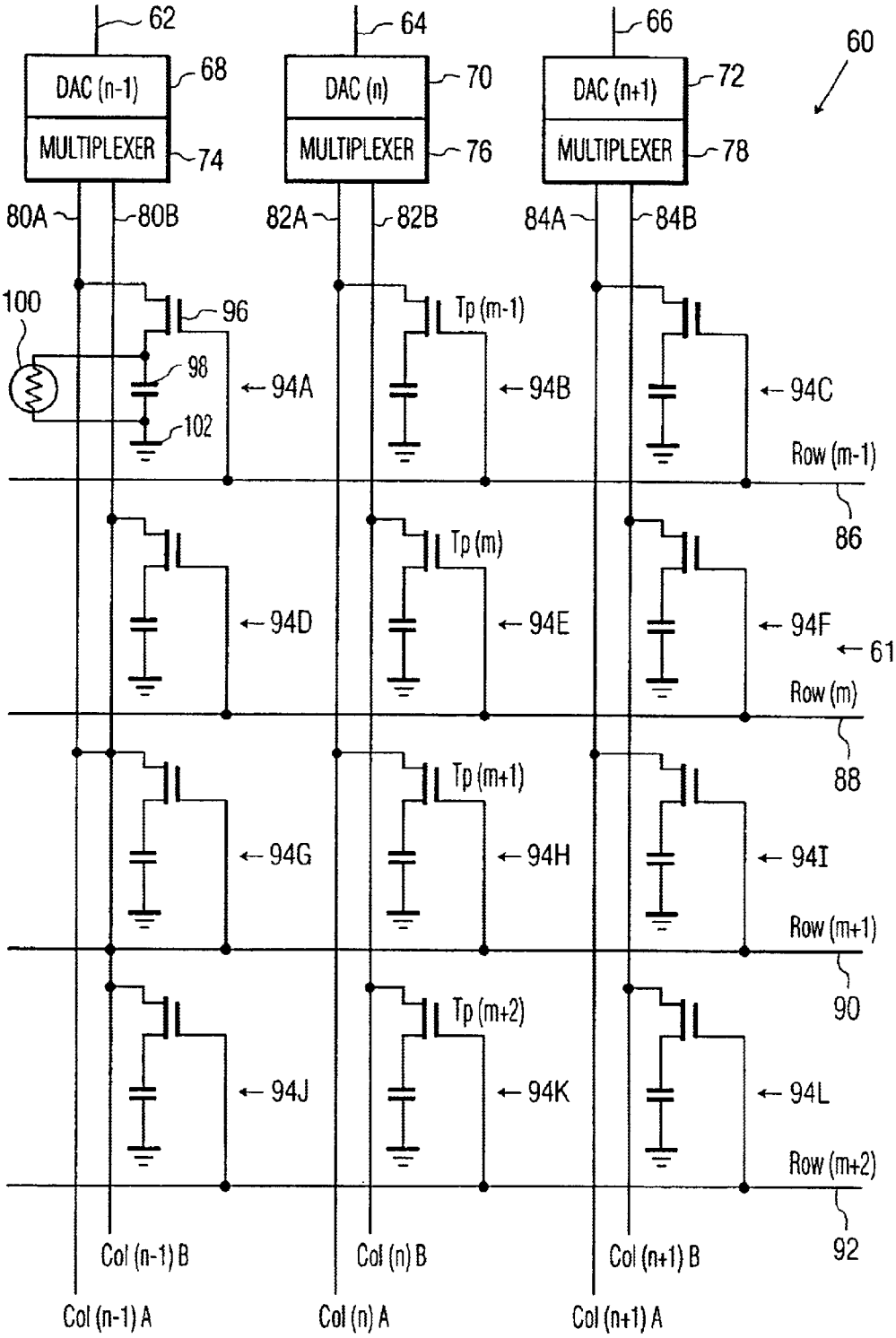
FIG. 3 depicts a column driving circuit in accordance with the present invention.

Referring now to FIG. 3, a column driving circuit 60 for driving pixels in a column row matrix 61 in accordance with the present invention is shown. As depicted, circuit 60 includes input signals 62, 64, and 66, which are preferably digital signals. The signals are received in DACs 68, 70 and 72 where they are converted to analog signals. Once converted, the signals are then communicated to multiplexing circuits 74, 76, and 78. The multiplexing circuits 74, 74, and 78 split each column into multiple column lines 80A–B, 82A–B, and 84A–B. Thus, instead of each DAC outputting an analog signal into a single line (as shown in FIGS. 1 and 2), the signal is outputted over multiple lines. Although each column is shown as being split into two column lines, it should be understood that any quantity of column lines could be formed (e.g., 4, 6, 8, etc.).

By splitting each column into two column lines, the capacitance of each column line is approximately one-half that of each column of circuits 10 and 50. As will be described in further detail below, the multiplexing circuits 74, 76, and 78 alternate the respective analog signal between the two column lines in each pair. Thus, for example, while one column line 80A receives the analog signal, the corresponding column line 80B does not. Thus, under the present invention, it is not necessary for each column line to be in communication with each row 86, 88, 90, and 92 thereby reducing the parasitic capacitance for each column line. Specifically, as shown in FIG. 3, each column line preferably includes junctions 94A–L to a unique subset of rows. For example, column lines 80A, 82A, and 84A are in communication with rows 86 and 90, while column lines 80B, 82B, and 84B are in communication with rows 88 and 92. By not requiring each column line to communicate with each row, the effects of the parasitic capacitance of each junction are reduced.

As further shown in FIG. 3, the junctions generally comprise transistor 96, capacitor 98, pixel 100, and ground 102. It should be understood, however, that a pixel is shown only in junction 94A for clarity purposes, and all junctions include a pixel. To refresh the display on which the column row matrix 61 is implemented, each row is selectively activated for a period of time, which allows the analog signal to pass from the column lines, through the junctions corresponding to the activated row, and drive the pixels therein. For example, if row 86 were activated, the analog signals would pass from column lines 80A, 82A, and 84A, through junctions 94A–C, and drive pixels 100 (not shown in every junction).

Contrary to the teachings of circuits 10 and 50, as column lines 80A, 82A, and 84A are driving the pixels on row 86, column lines 80B, 82B, and 84B are being retraced to an initial state. The switches in the multiplexing circuits 74, 76, and 78 (described below) are configured such that while one column line 80A is receiving the analog signal, the corresponding column line 80B is being retraced to the initial state (i.e., the analog signal is alternated between the column lines in each pair). Thus, when row 86 is later deactivated so that row 88 can be activated, there is no delay in waiting for retrace to occur (i.e., it has already occurred). As indicated above, the elimination of this delay improves performance of the display. Accordingly, to refresh row 88, it would be activated, the analog signals would pass from column lines 80B, 82B, and 84B through junctions 94D–F, and drive the associated pixels 100 (not shown in every junction). Accordingly, splitting each column into two (or more) column lines not only reduces the line capacitance and ramp retrace delay, but also reduces parasitic capacitance by allowing each column line in a single pair to communicate with different rows of the column row matrix 61.

Figure 4:
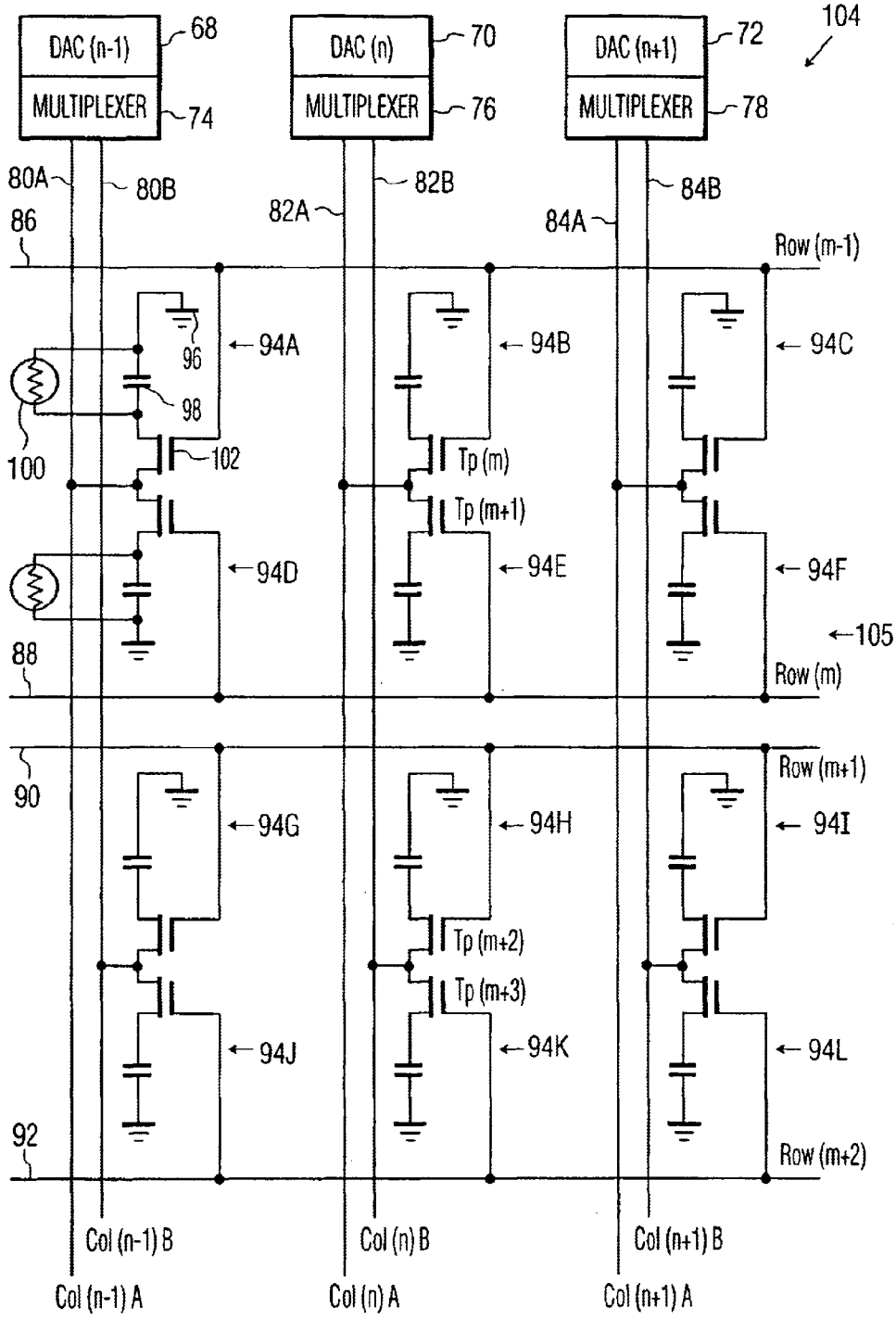
FIG. 4 depicts a first alternative embodiment of a column driving circuit in accordance with the present invention.

FIG. 4 shows an alternative embodiment of the present invention. Specifically, column driving circuit 104 drives the pixels 100 in column row matrix 105. Although the components of circuit 104 are similar to that of circuit 60, the architecture thereof is distinct. In particular, digital signals 62, 62, and 66 are received in DACs 68, 70, and 72, where they are converted to analog signals. From the DACs 68, 70, and 72, the analog signals are communicated through multiplexing circuits 74, 76, and 78, which splits each column into multiple (preferably two) column lines 80A–B, 82A–B, and 84A–B. However, instead of the column lines of each pair communicating with alternating rows as shown in FIG. 3, the column lines of each pair communicate with pairs or adjacent subsets of rows. Thus, rows 86 and 88 would be refreshed by a first column line 80A, 82A, and 84A while rows 90 and 92 would be refreshed by a second column line 80B, 82B, and 84B. For example, for row 86 was to be refreshed, it would first be activated. Then, the analog signals would pass from column lines 80A, 82A, and 84A through junctions 94A–C and drive the pixels 100.

As indicated above, the analog signals are alternated between the column lines in each pair so that while one column line is receiving the signal, the corresponding column line can be retraced back to the initial state. Once row 86 has been refreshed, it would be deactivated and, for instance, row 90 would be individually activated. Thus, the analog signal would be received by column lines 80B, 82B, and 84B and pass through junctions 94G–I to drive the pixels therein. Because retrace occurred while the signal passed through column lines 80A, 82A, and 84A, there is no delay in waiting for column lines 80B, 82B, and 84B to be retraced before driving the pixels.

Figure 5:
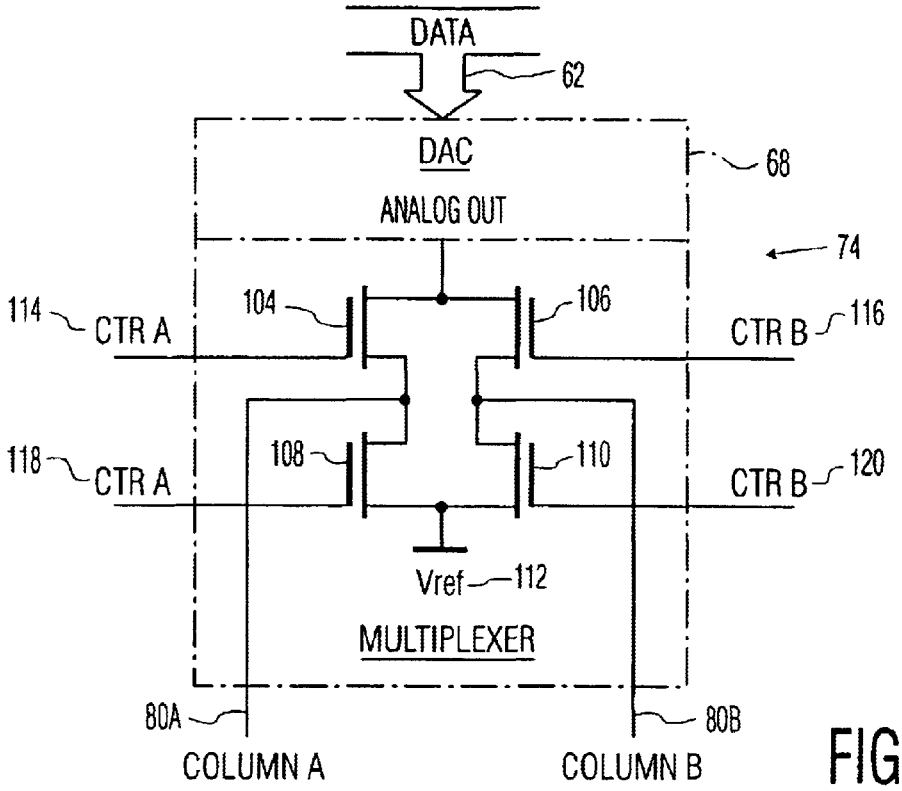
FIG. 5 depicts a multiplexing circuit in accordance with the present invention.

Referring now to FIG. 5, a first embodiment of the multiplexing circuit 74 is depicted. As shown, a digital signal 62 is received and converted by DAC 68 to analog. The multiplexing circuit 74 then receives the analog signal from DAC 68. As indicated above, the multiplexing circuit alternates the analog signal between column line 80A and 80B. Moreover, while one column line is receiving the analog signal, the other will receive a reference voltage 112 for simultaneous retracing to the initial state. These functions are provided by transistor signal switches 104 and 106 and transistor voltage switches 108 and 110. Specifically, when signal switch 104 is "on," signal switch 106 is "off" and the analog signal will pass through column line 80A. Moreover, when signal switch 104 is "on," voltage switch 110 corresponding to column line 80B will also be "on." This permits the reference voltage 112 to pass through column line 80B to retrace column line 80B to the initial state while column line 80A is receiving the analog signal. The switches 104, 106, 108, and 110 are controlled by signals 114, 116, 118, and 120, respectively. These signals activate the transistors in each switch to connect the column lines to the analog signal or voltage.

Once the rows corresponding to column line 80A have been refreshed and are deactivated, the rows corresponding to column line 80B can be activated for refreshing. As this occurs, signal switch 104 and voltage switch 110 will be turned "off" while signal switch 106 and voltage switch 108 are turned "on." This allows for the pixels of the rows corresponding to column line 80B to be driven with the analog signal while column line 80A is retraced to the initial state by reference voltage 112. As indicated above, this architecture and method eliminate the delay and problems associated with ramp retrace.

Figure 6:
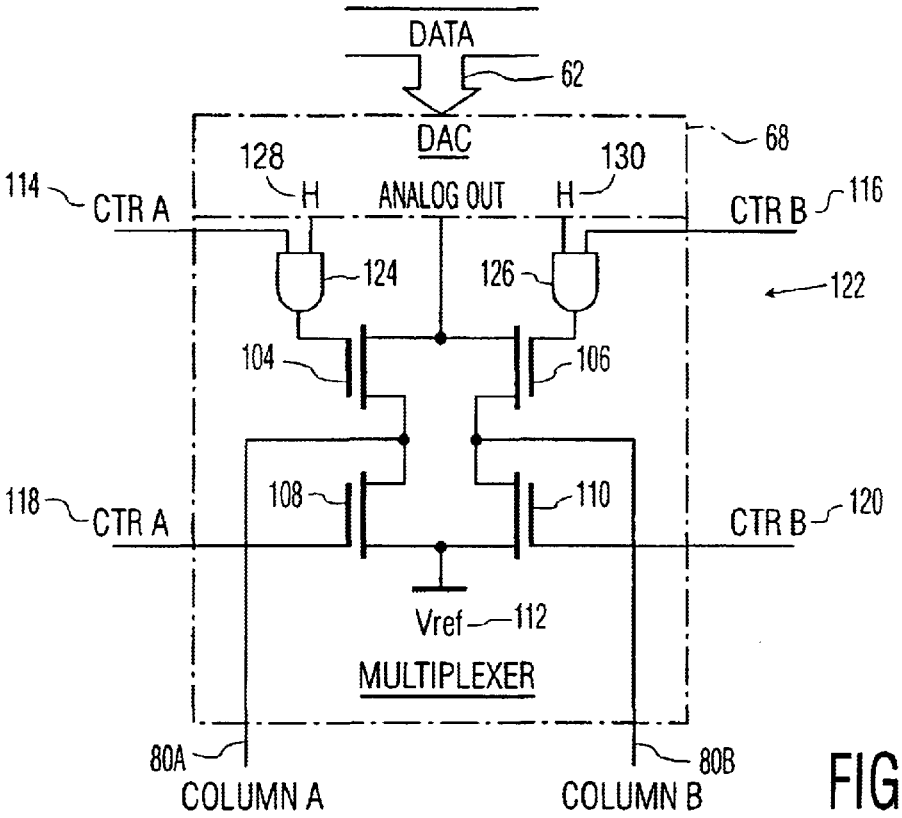
FIG. 6 depicts an alternative embodiment of a multiplexing circuit in accordance with the present invention.

Referring now to FIG. 6, an alternative embodiment of the multiplexing circuit 122 is shown. Similar to FIG. 5, the multiplexing circuit 74 receives a digital signal 62 and includes DAC 68, transistor signal switches 104 and 106 (controlled by signals 114 and 116), transistor voltage switches 112 (controlled by signals 118 and 120), and column lines 80A and 80B. However, multiplexing circuit 122 also includes hold signals 128 and 130 and "AND" gates 124 and 126. The hold signals 118 and 120 originate from the DAC 68, which in this embodiment is a "track and hold" DAC. By including a hold signal, the sampling switch is opened at the moment sampling is to occur. The difference between a "track and hold" and "sample and hold" is the duration the sampling switch is closed. Specifically, in a "sample and hold" embodiment, the sampling switch is closed for the shortest possible time. In "track and hold," the switch is closed from the very beginning of each cycle until it opens at "hold." Similar to the multiplexing circuit 74 of FIG. 5, the multiplexing circuit 122 will alternate the analog signal between the column lines 80A and 80B. The column line that is not receiving the analog signal will receive the reference voltage 112 for retracing to the initial state.

Figure 7:
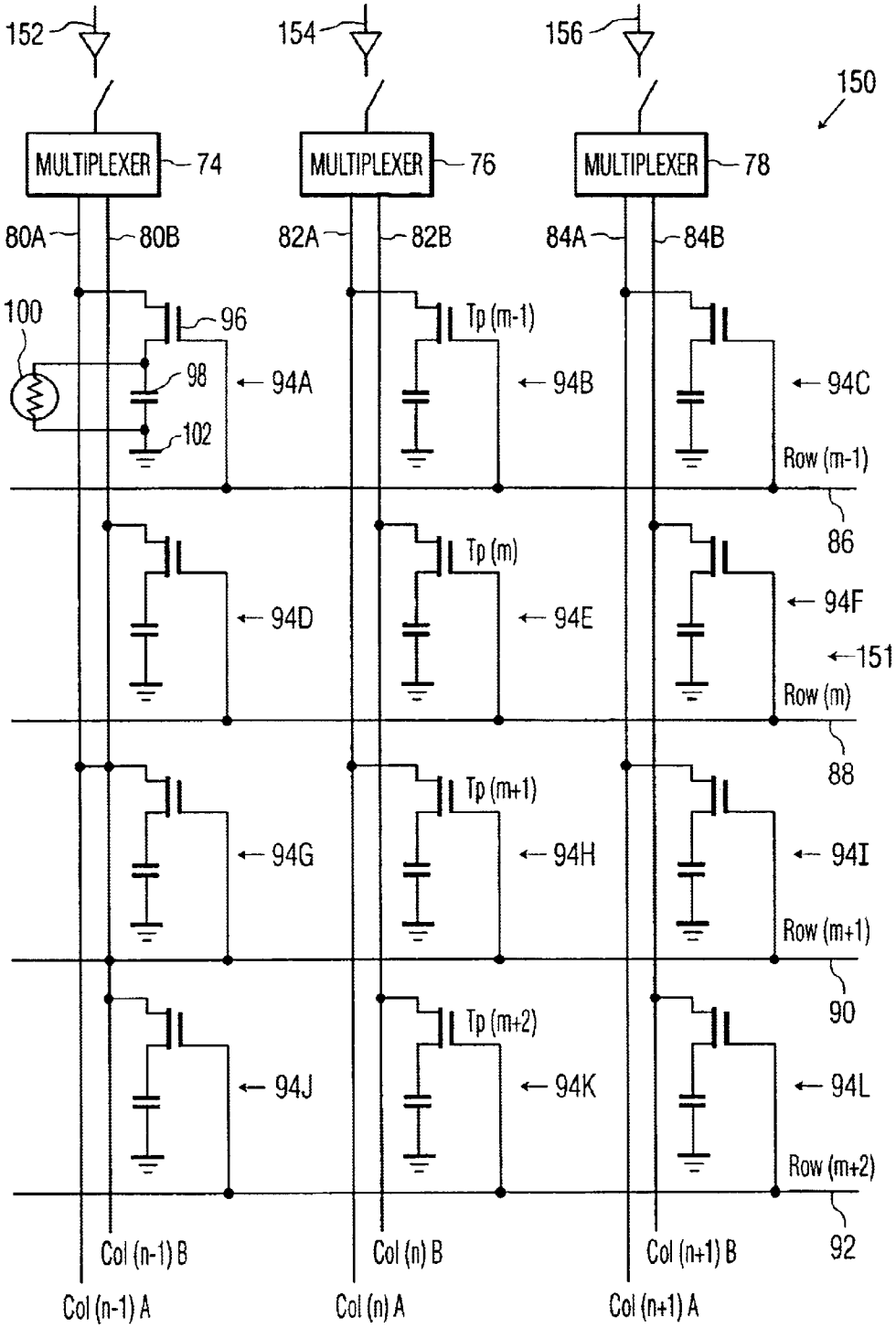
FIG. 7 depicts a second alternative embodiment of a column driving circuit in accordance with the present invention.

Referring now to FIG. 7, it should be appreciated a circuit according to the present invention need not require a DAC to drive the pixels. Specifically, if analog signals 152, 154, and 156 are provided directly to the multiplexing circuits 74, 76, and 78, there is no need to utilize a DAC. Thus, column driving circuit 150 (used to drive pixels in column row matrix 151) will receive input (analog) signals 152, 154, and 156 directly at multiplexing circuits 74, 76, and 78. Multiplexing circuits 74, 76, and 78 will then selectively apply the signals to column lines 80A–B, 82A–B, and 84A–B by alternating the signal between the two column lines of each column. Pixel driving will then occur as described above in conjunction with FIGS. 3 and/or 4.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed is:

1. A column driving circuit for driving pixels in a column row matrix, comprising:

a multiplexing circuit for receiving a signal;

a first and a second column line, wherein the column lines receive the signal from the multiplexing circuit, and wherein the first column line is in communication with different rows of the matrix than the second column line; and wherein the multiplexing circuit comprises a plurality of signal switches for alternating the signal between the first and second column lines, and a plurality of voltage switches for alternating a retrace reference voltage between the first and second column lines.

2. The circuit of claim 1, wherein the multiplexing circuit receives the signal from a digital to analog converter (DAC).

3. The circuit of claim 1, wherein the multiplexing circuit further comprising a hold signal for maintaining voltage in the first and second column lines.

4. The circuit of claim 1, wherein when the first column line is receiving the signal, the second column line is receiving the reference voltage.

5. The circuit of claim 1, wherein each column line includes at least one junction to a row in the matrix, and wherein each junction comprises:

a transistor;

a pixel; and a ground.

6. A column driving circuit for driving pixels in a column row matrix, comprising:

a DAC for generating an analog signal in response to a digital input;

a multiplexing circuit for receiving the signal from the DAC;

a first and a second column line, wherein the column lines alternate in receiving the signal from the multiplexing circuit, and wherein each column line includes at least one junction for communicating with a unique subset of rows in the matrix; and wherein the multiplexing circuit further comprises a plurality of signal switches for alternating the signal between the first and second column lines, and a plurality of voltage switches for alternating a retrace reference voltage between the first and second column lines.

7. The circuit of claim 6, wherein the multiplexing circuit further comprises a hold signal for maintaining voltage in the column lines.

8. The circuit of claim 6, wherein each junction comprises:

a transistor;

a pixel; and a ground.

9. The circuit of claim 6, wherein the column lines communicate with alternating rows.

10. The circuit of claim 6, wherein each column line communicates with adjacent pairs of rows.

11. The circuit of claim 6, wherein each junction joins one of the column lines to one of the rows.

12. A method for driving pixels in a column row matrix, comprising the steps of:

receiving a signal in a multiplexing circuit;

selectively sending the signal from the multiplexing circuit to a first and second column line;

communicating the column lines with rows of the matrix to drive the pixels. wherein the first column line communicates with different rows than the second column line; and wherein the multiplexing circuit further comprises a plurality of signal switches for alternating the signal between the first and second column lines, and a plurality of voltage signals for alternating a retrace reference voltage between the first and second column lines.

13. The method of claim 12, wherein the column lines communicate with the rows through junctions, and wherein each junction joins one of the column lines to one of the rows.

14. The method of claim 13, wherein each junction comprises:

a transistor;

a pixel; and a ground.

15. The method of claim 12, wherein the multiplexing circuit receives the signal from a DAC.

* * * * *